US009869457B1

(12) United States Patent
Lin et al.

(10) Patent No.: US 9,869,457 B1
(45) Date of Patent: Jan. 16, 2018

(54) WALL PACK LUMINAIRE WITH HANGING FEATURES FOR INSTALLATION

(71) Applicants: Wu Kun Lin, Dongguan (CN); Li Ren Chen, Fo Shan (CN); Nivay Sahaye, Lawrenceville, GA (US); James Richard Christ, Peachtree City, GA (US)

(72) Inventors: Wu Kun Lin, Dongguan (CN); Li Ren Chen, Fo Shan (CN); Nivay Sahaye, Lawrenceville, GA (US); James Richard Christ, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 184 days.

(21) Appl. No.: 14/994,244

(22) Filed: Jan. 13, 2016

Related U.S. Application Data

(60) Provisional application No. 62/102,828, filed on Jan. 13, 2015.

(51) Int. Cl.

| | |
|---|---|
| ***F21S 8/00*** | (2006.01) |
| ***F21V 19/00*** | (2006.01) |
| ***F21V 21/02*** | (2006.01) |
| ***F21V 23/00*** | (2015.01) |
| ***F21V 17/10*** | (2006.01) |
| *F21Y 101/02* | (2006.01) |

(52) U.S. Cl.
CPC ..... *F21V 19/001* (2013.01); *F21S 8/033* (2013.01); *F21V 17/10* (2013.01); *F21V 21/02* (2013.01); *F21V 23/009* (2013.01); *F21Y 2101/02* (2013.01)

(58) Field of Classification Search
CPC ..... F21V 23/009; F21V 19/001; F21V 17/10; F21V 17/102; F21V 17/14; F21V 17/16; F21V 17/164; F21V 17/18; F21V 21/02; F21S 8/033; F21S 8/036; F21S 8/037
See application file for complete search history.

(56) References Cited

U.S. PATENT DOCUMENTS

| | | | |
|---|---|---|---|
| D135,107 | S | 2/1943 | Szalla |
| 2,732,484 | A | 1/1956 | Lipscomb |
| 3,047,716 | A | 7/1962 | Hoxie et al. |
| D203,060 | S | 11/1965 | Schaefer |

(Continued)

*Primary Examiner* — Anh Mai
*Assistant Examiner* — Steven Horikoshi
(74) *Attorney, Agent, or Firm* — King & Spalding LLP

(57) ABSTRACT

A luminaire includes at least a cover and a mounting plate. The mounting plate includes one or more vertical protrusions and one or more horizontal protrusions that are substantially perpendicular to each other. Further, the mounting plate includes a tab that is substantially perpendicular to the one or more horizontal protrusions. The cover includes a pair of top apertures and a tab aperture. During installation of the luminaire, the cover is hung from the mounting plate by inserting each horizontal protrusion of the mounting plate through the respective top aperture of the cover. Alternatively, the cover is hung from the mounting plate by inserting the tab of the mounting plate through the tab aperture of the cover. After installation, the cover may be secured to the mounting plate by inserting the pair of vertical protrusions of the mounting plate through the pair of top apertures of the cover.

20 Claims, 4 Drawing Sheets

(56) References Cited

U.S. PATENT DOCUMENTS

| | | | | |
|---|---|---|---|---|
| 3,263,071 | A | 7/1966 | Fabbri | |
| D205,624 | S | 8/1966 | Pritchett | |
| D222,117 | S | 9/1971 | Baatz | |
| D228,667 | S | 10/1973 | Anderson, Jr. | |
| D248,184 | S | 6/1978 | Roberts | |
| D285,258 | S | 8/1986 | Hamasaki | |
| D287,646 | S | 1/1987 | Ayukawa | |
| D289,087 | S | 3/1987 | Kobata | |
| D380,853 | S | 7/1997 | Johnson | |
| 5,957,573 | A | 9/1999 | Wedekind et al. | |
| D415,305 | S | 10/1999 | Putman | |
| D421,816 | S | 3/2000 | Gongora et al. | |
| 6,135,618 | A * | 10/2000 | Tai | F21S 8/033 220/3.7 |
| 6,378,173 | B1 | 4/2002 | Ho | |
| D456,932 | S | 5/2002 | Crosby | |
| D465,048 | S | 10/2002 | Gaskins | |
| D465,050 | S | 10/2002 | Crelin | |
| D472,339 | S | 3/2003 | Russello | |
| D499,834 | S | 12/2004 | Yu et al. | |
| 6,905,222 | B1 | 6/2005 | Russello et al. | |
| D527,134 | S | 8/2006 | Bagen | |
| D541,463 | S | 4/2007 | Tortel | |
| D544,991 | S | 6/2007 | Guercio | |
| D552,292 | S | 10/2007 | Martineau | |
| D553,789 | S | 10/2007 | Akinrele et al. | |
| 7,311,426 | B2 | 12/2007 | Tiesler | |
| D562,491 | S | 2/2008 | Dicola | |
| D568,524 | S | 5/2008 | Sandell | |
| 7,387,410 | B2 | 6/2008 | Sibout | |
| D574,995 | S | 8/2008 | Boyer | |
| D577,146 | S | 9/2008 | Haugaard et al. | |
| D578,242 | S | 10/2008 | Couillard | |
| D578,702 | S | 10/2008 | Campagna | |
| D579,141 | S | 10/2008 | Guercio | |
| D579,144 | S | 10/2008 | Wnek et al. | |
| D590,088 | S | 4/2009 | Dworschak | |
| D590,983 | S | 4/2009 | Sabernig | |
| D595,447 | S | 6/2009 | Purcell | |
| D604,004 | S | 11/2009 | Guercio | |
| D608,040 | S | 1/2010 | Guercio | |
| 7,651,245 | B2 | 1/2010 | Thomas | |
| D609,387 | S | 2/2010 | Compton | |
| D610,296 | S | 2/2010 | Boissevain | |
| D612,975 | S | 3/2010 | Guercio et al. | |
| D617,491 | S | 6/2010 | Dordoni | |
| D626,271 | S | 10/2010 | Verelst | |
| 7,862,197 | B2 | 1/2011 | Gebhard | |
| D634,873 | S | 3/2011 | Guercio | |
| D634,878 | S | 3/2011 | Guercio et al. | |
| D643,147 | S | 8/2011 | Guercio et al. | |
| D643,571 | S | 8/2011 | Chen | |
| D644,370 | S | 8/2011 | Lickiss | |
| D646,822 | S | 10/2011 | Johannessen | |
| D647,662 | S | 10/2011 | Verelst et al. | |
| D650,112 | S | 12/2011 | Bryant | |
| D653,377 | S | 1/2012 | Guercio et al. | |
| D658,803 | S | 5/2012 | Maxik et al. | |
| D659,895 | S | 5/2012 | Maxik et al. | |
| D668,810 | S | 10/2012 | Bryant | |
| D676,173 | S | 2/2013 | Akinrele | |
| D678,596 | S | 3/2013 | Bryant | |
| D681,864 | S | 5/2013 | Guercio | |
| D688,406 | S | 8/2013 | Goldy | |
| D691,320 | S | 10/2013 | Guercio et al. | |
| D695,445 | S | 12/2013 | Panchisin et al. | |
| D698,978 | S | 2/2014 | Bryant | |
| D698,986 | S | 2/2014 | Reynolds | |
| D699,386 | S | 2/2014 | Park et al. | |
| D699,887 | S | 2/2014 | Chen | |
| D707,385 | S | 6/2014 | Wardenburg et al. | |
| D714,990 | S | 10/2014 | Yu | |
| D714,992 | S | 10/2014 | Bryant | |
| D715,477 | S | 10/2014 | Yu | |
| D716,990 | S | 11/2014 | Yu | |
| D719,699 | S | 12/2014 | Bryant | |
| D728,142 | S | 4/2015 | Dungan | |
| D730,569 | S | 5/2015 | Bryant | |
| D739,068 | S | 9/2015 | Bryant | |
| D742,572 | S | 11/2015 | Khayat | |
| D744,684 | S | 12/2015 | Guercio | |
| 9,212,813 | B2 | 12/2015 | Wang | |
| 2003/0021104 | A1 | 1/2003 | Tsao | |
| 2007/0029456 | A1 | 2/2007 | Mier-Langner et al. | |
| 2008/0089060 | A1 | 4/2008 | Kondo | |
| 2008/0232081 | A1 | 9/2008 | Martinez | |
| 2010/0079991 | A1 | 4/2010 | Zhang | |
| 2012/0268952 | A1 | 10/2012 | Newton | |
| 2015/0062932 | A1 | 3/2015 | Wang | |

* cited by examiner

WALL PACK LUMINAIRE WITH HANGING FEATURES FOR INSTALLATION

CROSS REFERENCE TO RELATED APPLICATIONS

This non-provisional patent application claims priority under 35 U.S.C. §119 to U.S. Provisional Patent Application No. 62/102,828, titled Wall Pack Luminaire with Hanging Features for Installation, filed on Jan. 13, 2015, which is hereby fully incorporated herein by reference.

TECHNICAL FIELD

Embodiments relate generally to lighting solutions, and more particularly to systems, methods, and devices for facilitating the installation of a luminaire.

BACKGROUND

Various types of luminaires can be mounted. One particular type of luminaire is known as a wall pack luminaire. A wall pack luminaire is typically attached to a support structure, such as a vertically oriented wall. Many wall pack light fixtures include housings formed of two or more individual components coupled to one another. The individual components of the housing include at least a mounting portion and a cover coupled to the mounting portion. The wall pack luminaire typically houses one or more light sources for providing illumination to a desired illuminated area.

Installation of the housing of conventional wall pack light fixtures occurs in at least two separate steps. The mounting portion is first mounted to the wall or other support structure and then the cover is later coupled to the mounting portion in a proper position. During the step where the mounting portion is mounted to the wall, the mounting portion is securely mounted to the wall or is attached to a J-box. One or more electrical wires that are located within or adjacent to the support structure are routed into the mounting portion and electrically coupled to the light source, thereby providing current to the light source. While the installer connects the electrical wires to the light source, the cover is typically propped in an inconvenient and/or awkward manner. In certain instances, the inconvenient manner in which the cover is propped causes the installer to rush through the installation and possibly make mistakes.

Conventional approaches to propping the cover include the installer holding the cover in one hand, thereby causing the installer to make wiring connections with the other hand. This approach is very inconvenient to the installer and does not allow the installer to easily make the connections. Another conventional approach to propping the cover includes placing the cover on a ladder. This approach is not safe since the cover can fall off of the ladder and be damaged or cause injury to a person. Alternatively, the placement of the cover can interfere with the installer's installation of the luminaire.

Another conventional approach to propping the cover includes placing the cover on a safety cable. This approach adds additional time for setting up and disassembling the safety cable, which therefore adds additional costs for the installation. Also, the cover can be inadvertently disconnected from the safety cable or can interfere with the installation.

Another conventional approach to propping the cover includes using captive hinges located along an edge of the wall pack luminaire that allow the cover to rotate open. This approach requires that there be sufficient room in front of the wall pack light fixture so that the cover can fully rotate about the captive hinges. Thus, the installer has to lean backwards to allow the cover to rotate, which can cause the installer to fall off the ladder. Alternatively, the installer has to maintain his ladder a required distance away from the wall pack light fixture so that when he climbs up the ladder, he is not interfering with the rotation of the cover. In this situation, the installer has to lean forward to perform the installation of the fixture because the ladder is not positioned as close to the fixture as typically desired.

In view of the foregoing shortcomings, there is a need to facilitate the mounting of a luminaire when the luminaire consists of two or more components. In particular, there is a need to be able to easily and securely position a cover of the luminaire while wiring connections can be completed during the installation of a luminaire.

SUMMARY

In one aspect, the present disclosure can relate to a luminaire. The luminaire includes a mounting plate that includes a plurality of vertical protrusions disposed along a top edge of the mounting plate and a plurality of horizontal protrusions disposed along an inner surface of the mounting plate. Further, the luminaire includes a cover that includes a plurality of top apertures and a light source coupled to a driver. The plurality of horizontal protrusions are inserted into the plurality of top apertures such that the driver can be coupled to a power source during installation of the luminaire. Further, the plurality of vertical protrusions are inserted into the plurality of top apertures after the installation and when the luminaire is operational.

In another aspect, the present disclosure can relate to a luminaire. The luminaire includes a mounting plate that includes a plurality vertical protrusions disposed along a top edge of the mounting plate and a tab disposed along the top edge of the mounting plate. Further, the luminaire includes a cover that includes a plurality of top apertures, a tab aperture, and a light source coupled to a driver. The tab is inserted into the tab aperture such that the driver can be coupled to a power source during installation of the luminaire. Further, the plurality of vertical protrusions are inserted into the plurality of top apertures after the installation and when the luminaire is operational.

In yet another aspect, the present disclosure can relate to a method for installing a luminaire. The method includes securing a mounting plate of the luminaire to a support. Further, the method includes inserting horizontal protrusions on an inner surface of the mounting plate into top apertures in a cover of the luminaire so that the cover hangs from the mounting plate. Then, the method includes connecting a driver to a power source. In particular, the driver is coupled to a light source disposed within the cover. Furthermore, the method includes removing the cover from the horizontal protrusions and inserting vertical protrusions on a top edge of the mounting plate into the top apertures thereby securing the cover to the mounting plate.

These and other aspects, objects, features, and embodiments will be apparent from the following description and the appended claims.

BRIEF DESCRIPTION OF THE FIGURES

Reference will now be made to the accompanying figures, which are not necessarily to scale, and wherein.

Figure 1:
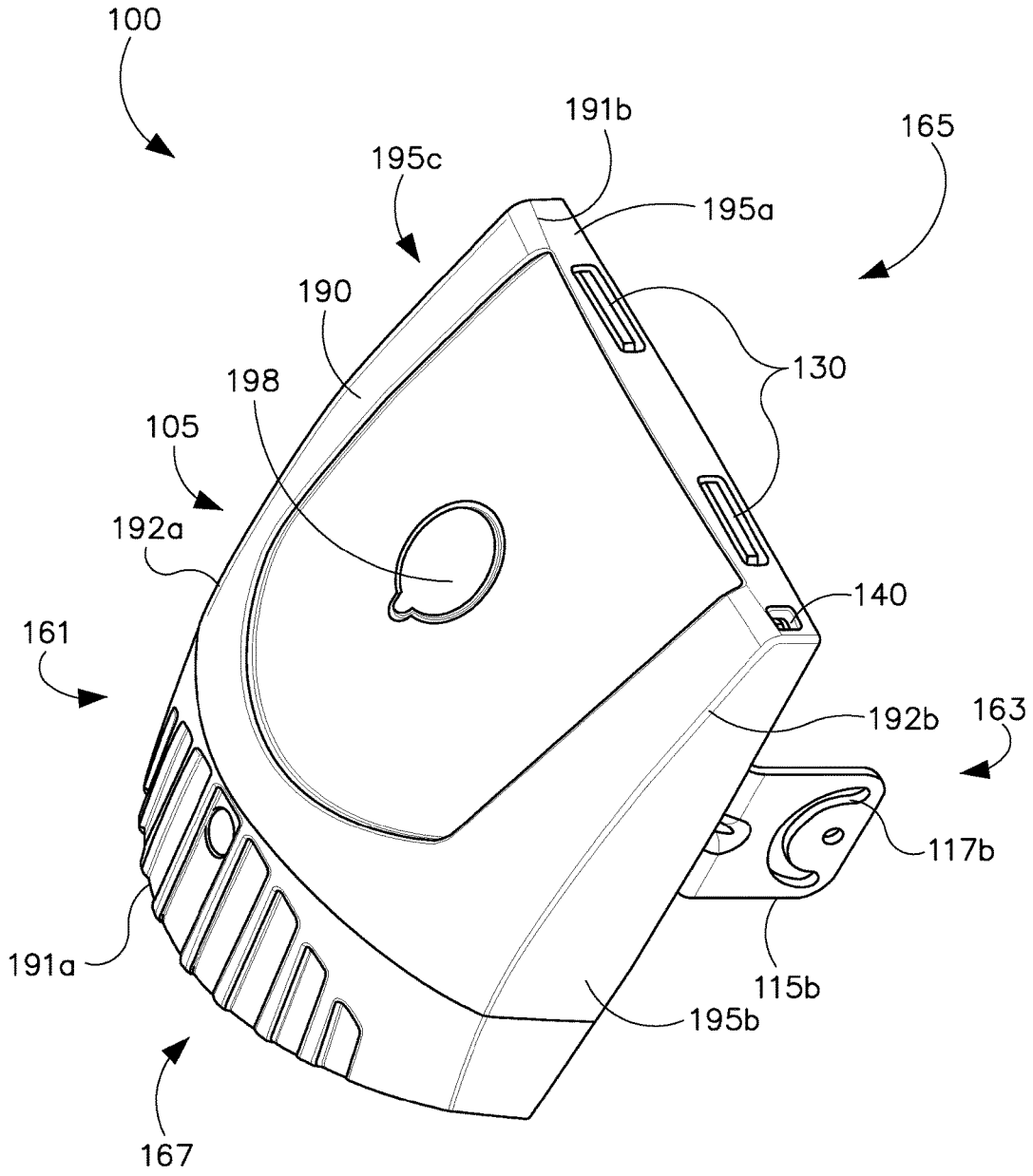
FIG. 1 is a front perspective view of a luminaire in accordance with an example embodiment.

The figures illustrate only particular embodiments and are therefore not to be considered limiting in scope. The elements and features shown in the figures are not necessarily to scale, emphasis instead being placed upon clearly illustrating the principles of the particular embodiments. Additionally, certain dimensions or placements may be exaggerated to help visually convey such principles. In the figures, reference numerals designate like or corresponding, but not necessarily identical, elements.

DETAILED DESCRIPTION OF EXAMPLE EMBODIMENTS

Example embodiments disclosed herein are directed to a wall pack luminaire or light fixture. However, those of skill in the field will recognize that the teachings described herein can be applied to other types of luminaires or light fixtures that comprise two or more components that are separated during installation or mounting.

Figure 2:
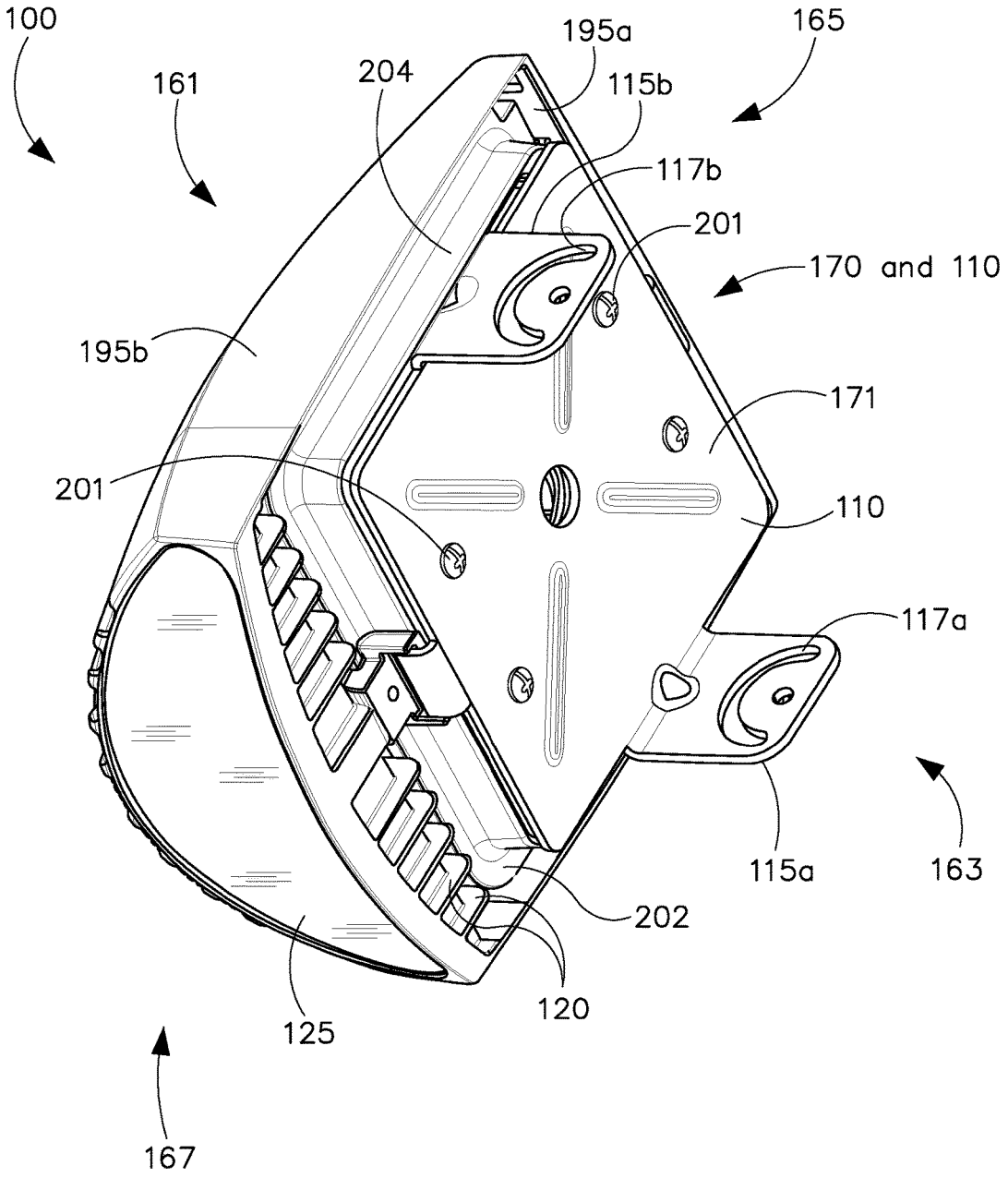
FIG. 2 is a back perspective view of a luminaire in accordance with an example embodiment.
Figure 3:
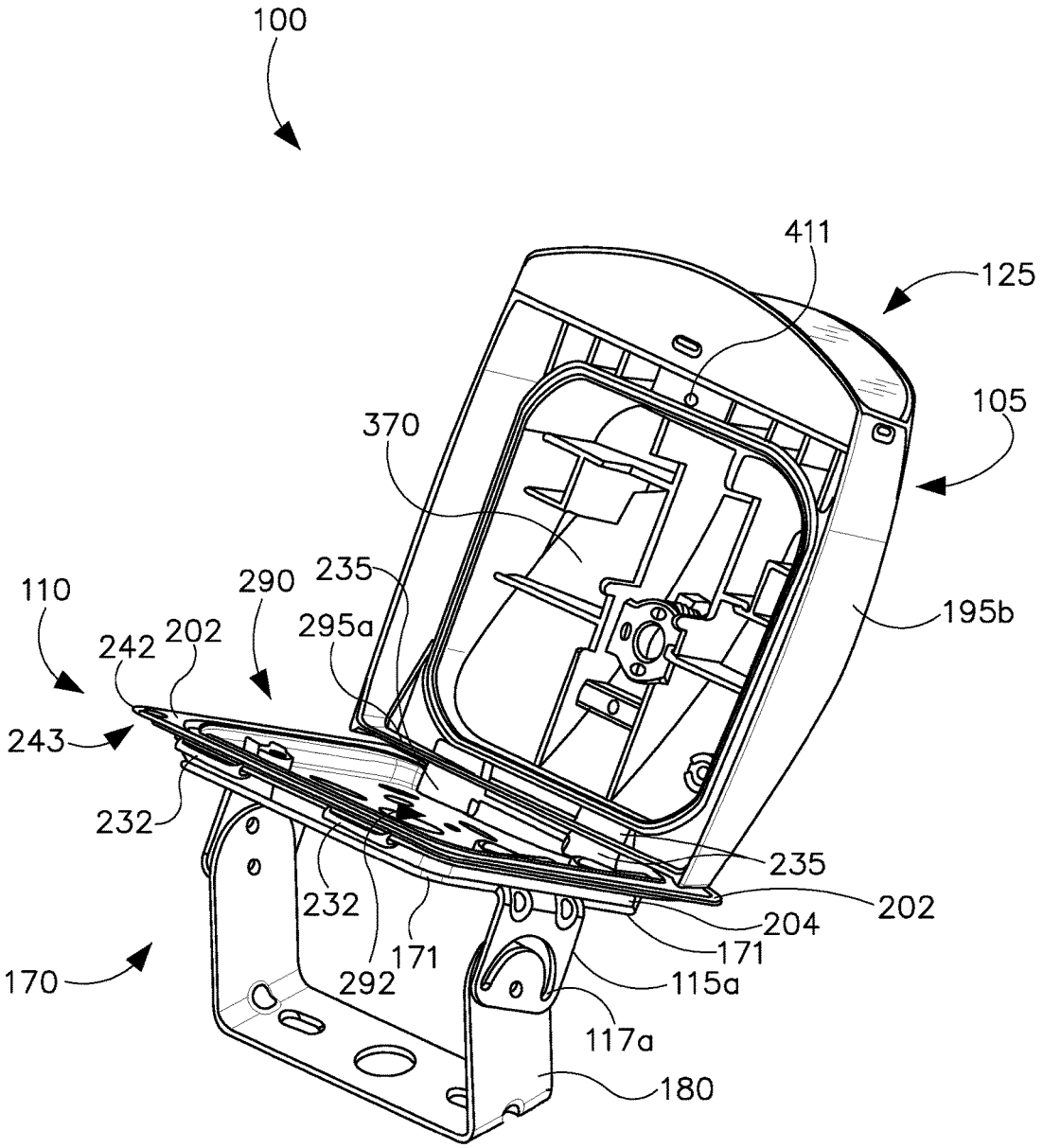
FIG. 3 is a perspective view of a luminaire cover hanging on a mounting plate in a first position in accordance with an example embodiment.
Figure 4:
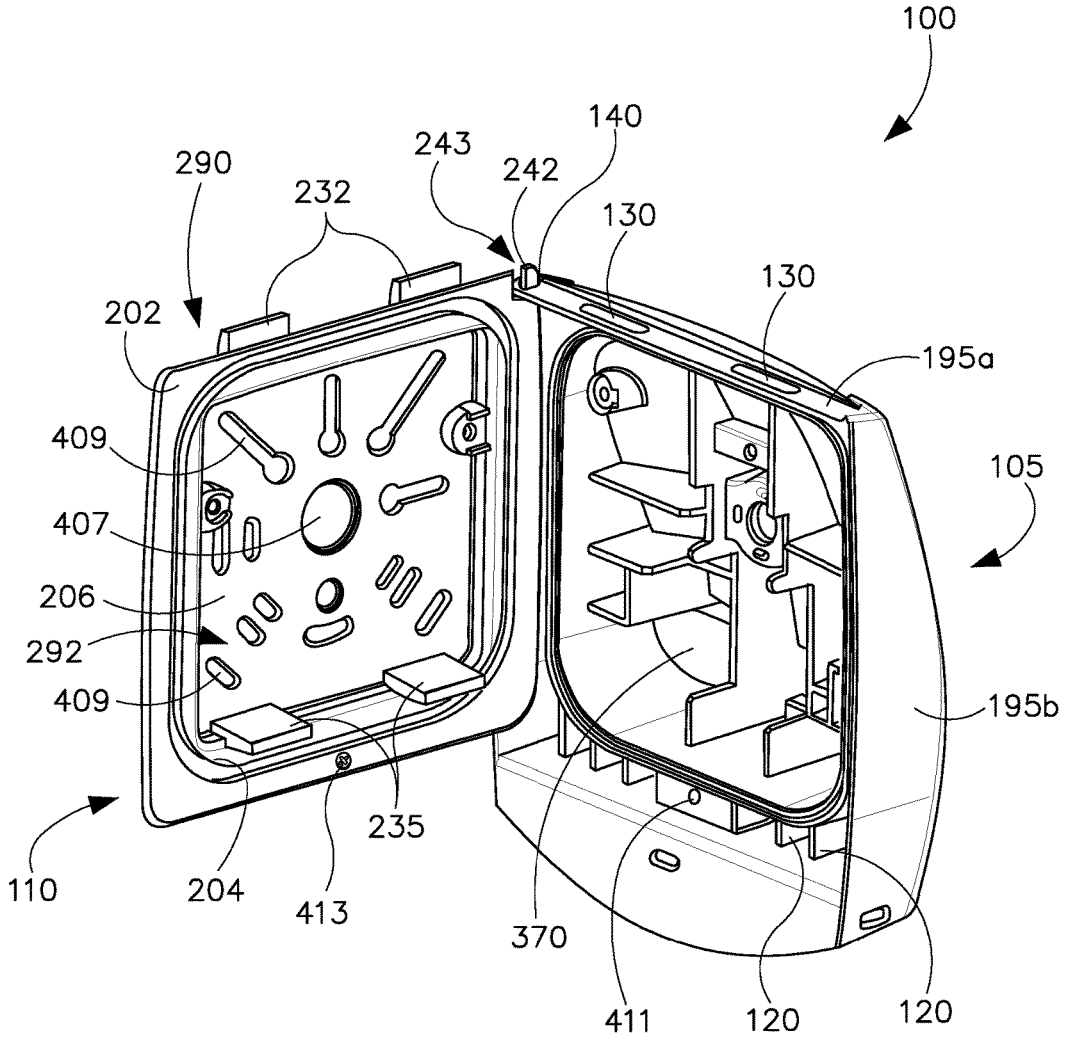
FIG. 4 is a perspective view of a luminaire cover hanging on a mounting place in a second position in accordance with an example embodiment.

FIGS. 1 and 2 illustrate front and back perspective views of an example wall pack luminaire 100 in accordance with the present disclosure. Further, FIG. 3 is a perspective view of a luminaire cover hanging on a mounting plate in a first position in accordance with an example embodiment; and FIG. 4 is a perspective view of a luminaire cover hanging on a mounting place in a second position in accordance with an example embodiment. Referring to FIGS. 1-4, the example wall pack luminaire 100 (herein 'luminaire 100') comprises a mounting plate 110 and a cover 105 that are attached to each other. The following paragraphs will describe the mounting plate 110 and the cover 105 in greater detail.

The Mounting Plate 110

As shown in FIGS. 2-4, the example mounting plate 110 may include a base flange 202 that defines an aperture 290, a side wall 204 that extends substantially perpendicular to the base flange 202 along a perimeter of the aperture 290 and protrudes outward from the base flange 202, and a top wall 206 defined by the edges of the side wall 204. In particular, the base flange 202, the side wall 204, and the top wall 206 of the mounting plate 110 may define a cavity 292 that is open on one side (aperture 290) as shown in FIGS. 3-4. Further, the top wall 206 may include an input aperture 407 (shown in FIG. 4) that can receive an input cable connecting one or more electrical components inside the luminaire 100 to an external power supply. Furthermore, the top wall 206 may include one or more securing apertures 409 (shown in FIG. 4) that can receive fasteners to directly attach the mounting plate 110 to a mounting surface, such as a wall (not shown in Figures) and/or to couple the mounting plate 110 to a mounting bracket 170.

In particular, in an example embodiment where the mounting plate 110 is directly attached to the mounting surface, the side wall 204 of the mounting plate 110 that protrudes outwards may offset the base flange 202 of the mounting plate 110 from the mounting surface. That is, the side wall 204 that protrudes out may provide an offset shape to the mounting plate 110 which in turn creates a space/clearance between the mounting surface and the luminaire 100 when the mounting plate 110 is directly attached to the mounting surface. In certain example embodiments, as illustrated in FIGS. 1-3, the mounting plate 110 may be indirectly attached to the mounting surface via a mounting bracket 170 and/or a mounting stand 180. In particular, the mounting plate 110 may be coupled to a mounting bracket 170 using one or more fasteners 201, e.g., screws passing through the securing apertures 409 of the mounting plate 110 as illustrated in FIG. 2. The mounting bracket 170 may include a base member 171 and two side flanges 115*a* and 115*b* that extend substantially perpendicular to the base member 171 from opposite sides of the base member 171 as illustrated in FIG. 2. Further, each side flange 115*a* and 115*b* may include an elongated slot 117*a* and 117*b* that allows a mounting stand 180 to be rotatably coupled to the mounting bracket 170. The mounting stand 180 may be attached/secured to a wall or other support in order to indirectly couple the luminaire 100 to the mounting surface.

In addition to the input aperture 407 and the securing apertures 409, the mounting plate 110 may include a locking aperture 411 located on the base flange 202 as illustrated in FIG. 4. The locking aperture 411 may receive a fastener therethrough to lock the mounting plate 110 and the cover 105 in place once the installation is completed and the luminaire 100 is operational.

As illustrated in FIG. 4, the mounting plate 110 may further include a pair of vertical protrusions 232 that extend outwardly from a top edge of the mounting plate 110, i.e., from the base flange 202 along a substantially similar plane or parallel plane encompassing the mounting plate 110. In addition to the pair of vertical protrusions, the mounting plate 110 may include a tab 242 defined by a notch 243 that is cut out from a portion of the base flange 202, as illustrated in FIG. 4. That is, the tab 242 may be formed in the base flange 202 adjacent the notch 243. In particular, the tab 242 may extend in substantially the same direction as that of the pair of vertical protrusions 232 and may be located at an edge of the base flange 202. Furthermore, as illustrated in FIG. 4, the mounting plate 110 may include a pair of horizontal protrusions 235 that extend outwardly from an inner surface of the mounting plate's side wall 204. In particular, the horizontal protrusions 235 may extend past a width of the side wall 204 in a direction that is substantially perpendicular (or at an appropriate angle) to the pair of vertical protrusions 232.

Even though FIG. 4 illustrates the vertical protrusions 232 and horizontal protrusions 235 as being located on opposite sides of the mounting plate 110, one of ordinary skill in the art can understand and appreciate that in other embodiments, the vertical protrusions 232 and horizontal protrusions 235 may be positioned on the same side of the mounting plate 110 or at any other appropriate positions without departing from a broader scope of the present disclosure. Further, even though FIG. 4 illustrates the tab 242 being adjacent the pair of vertical protrusions 232 and located on the same side as that of the pair of vertical protrusions 232, one of ordinary skill in the art can understand and appreciate that in other embodiments, the tab 242 may be located at any other position along the base flange 202 or any other portion of the mounting plate 110 without departing from a broader scope of the present disclosure. Furthermore, even though the present disclosure describes the mounting plate 110 and/or the mounting bracket 170 as having a specific shape and structure, one of ordinary skill in the art can understand and appreciate that the mounting plate 110 and/or the mounting bracket 170 can have any other appropriate shape or structure without departing from a broader scope of the present disclosure.

The Cover 105

As illustrated in FIGS. 1-4, the cover 105 may include a substantially rectangular top surface 190 located at a top portion 161 of the luminaire 100. The top surface 190 of the cover 105 may be defined by a first lateral edge 191*a*, a second lateral edge 191*b*, a first longitudinal edge 192*a*, and the second longitudinal edge 192*b*, Further, the cover 105 may include a set of side walls 195*a-c* that extend substantially perpendicularly from one or more edges (191*b*, 192*a*, 192*b*) of the top surface 190. In particular, the cover 105 may include a rear side wall 195*a* located at a rear portion 165 of the cover 105 and extending from a second lateral edge 191*b* of the top surface 105, a first longitudinal side wall 195*b* that extends from the first longitudinal edge 192*a* of the top surface 105, and a second longitudinal side wall 195*c* that extends from the second longitudinal edge 192*b* of the top surface 105. Additionally, the cover 105 may include a lens 125 that is disposed at a front portion 167 of the luminaire 100 adjacent the first lateral edge 191*a* of the cover's top surface 190 and extending substantially perpendicular to the cover 105.

Although not shown in the figures, one or more light sources may be positioned behind the lens 125 within a cavity 370 (shown in FIG. 3) defined by the top surface 105 and the side walls 195*a-c* of the cover 105. When the luminaire 100 is mounted to a wall or other support, light is emitted from the light source through the lens 125 and downward from the luminaire 100. A variety of light sources can be used in the example embodiments shown in the figures including LEDs and incandescent light sources. Recent lighting technology has seen a trend towards lighting devices that use LEDs as a primary light source. LEDs typically offer advantages over traditional light sources such as increased energy efficiency, durability, and cost-effectiveness. LEDs also offer the advantage of typically being more compact than incandescent or other conventional light sources. One type of commonly used LED is a discrete LED, otherwise known as a standard LED. A second type of LED is a chip-on-board LED.

In certain example embodiments, the lens 125 can be any one of a variety of translucent materials including glass, acrylic, or polycarbonate. In certain other example embodiments, the luminaire 100 may not have lens 125 and instead may have an open cavity from which light is emitted. In some example embodiments, the lens 125 can be located at any other position on the cover 105 without departing from a broader scope of the present disclosure. In addition to the lens, the cover 105 may include fins 120 located at a bottom portion 163 of the luminaire 100 proximate to the one or more light sources in order to dissipate heat generated by the one or more light sources. The fins 120 can also provide stability and support for the cover 105.

As illustrated in FIG. 4, the rear side wall 195*a* of the cover 105 may include a pair of top apertures 130, each top aperture 130 configured to receive a respective vertical protrusion 232 of the pair of vertical protrusions 232 or a respective horizontal protrusion 235 of the pair of horizontal protrusions 235. For example, as illustrated in FIG. 1, after the luminaire 100 has been installed and is operational, the cover 105 is placed on top of the mounting plate 110 and secured to the mounting plate 110 by inserting the two vertical protrusions 132 into the the two top apertures 130 of the cover 105. In addition to the top apertures 130, the rear side wall 195*a* of the cover 105 may include a tab aperture 140 that is positioned adjacent the top apertures 130 and configured to receive the tab 242 of the mounting plate 110 for hanging the cover 105 on the mounting plate 110 during installation. Even though FIGS. 1-4 illustrate the two top apertures 130, the tab aperture 140, the two vertical protrusions 232, the tab 242, and the two horizontal protrusions 235 as having a specific shape and structure, one of ordinary skill in the art can understand and appreciate that the top apertures 130, the tab aperture 140, the vertical protrusions 232, the tab 242, and the horizontal protrusions 235 of the luminaire can have different or any appropriate shapes and may be placed in other any other appropriate locations on the luminaire without departing from a broader scope of the present disclosure.

In addition to the top apertures 130 and the tab aperture 140, the cover 105 may include a locking aperture 411 that may receive a fastener to lock the cover 105 to the mounting plate 110 in place. In particular, the locking aperture 411 of the cover 105 and the locking aperture 413 of the mounting plate 110 may be aligned and a fastener may be placed through the aligned locking apertures (413, 411) to lock the cover 105 and the mounting plate 110 in place.

Furthermore, as illustrated in FIG. 1, the top surface 190 of the cover 105 may include a closed aperture 198 that can be pried/cut open to attach an appropriate sensor or switch to the luminaire 100. In one example, the closed aperture 198 may be opened to attach a photo sensor to the luminaire 100 for providing a dusk to dawn lighting function. In another example, the closed aperture 198 may be opened to attach a motion sensor to the luminaire 100. Even though FIG. 1 shows a closed aperture, one of ordinary skill in the art can understand and appreciate that in some embodiments the cover 105 may have no such closed apertures 198.

As described above and as illustrated in FIG. 3, the cover 105 may define an interior cavity 370 that is configured to house one or more electronic components (e.g., LED driver) and/or electrical wiring that provide power to the light source (or connect light source to external power supply). Additionally, in some embodiments, the interior cavity 370 of the luminaire 100 may be configured to house one or more battery packs allowing the luminaire 100 to operate as a stand-alone device. Alternatively, the battery packs may operate as a back-up power source in case of a power failure of the a primary power source of the luminaire 100.

Hanging the Cover 105 on the Mounting Plate 110 During Installation (e.g., Wiring Connection Installation)

The arrangement in FIG. 3 shows one technique for hanging the cover 105 on the mounting plate 110 that permits the installer to complete the wiring connections from the driver to the power source during the installation process. In the example arrangement shown in FIG. 3, the mounting plate 110 may be secured to a mounting surface (e.g., wall (not shown)) via the mounting bracket 170 and/or the rotatable mounting stand 180. Once the mounting plate 110 is secured to the mounting surface, the horizontal protrusions 235 disposed on an inner surface of the mounting plate 110 are inserted into the top apertures 130 in the cover 105 so that the cover 105 hangs from the mounting plate 110 while at the same time providing enough clearance to complete any wiring connections. By hanging the cover 105 onto the mounting plate 110 as shown in FIG. 3, the installer no longer is required to use his hands to hold the cover 105 in proximity to the mounting plate and the power source (not shown) and instead, can have two free hands to complete the wiring for the luminaire. Once the wiring connections are completed, the installer can remove the cover 105 from the horizontal protrusions 235 and invert (or re-orient) the cover 105 such that the vertical protrusions 132 can be inserted into the top apertures 130 to secure the cover 105 to the mounting plate 110 as described above and illustrated in FIG. 1.

As described above, the example wall pack luminaire 100 also includes a tab 242 which provides an alternate mechanism for hanging the cover on the mounting plate 110. An example showing use of a tab 242 will be described further in connection with FIG. 4. It should be recognized that although mounting plate 110 provides two different options for hanging the cover 105 on the mounting plate 110, one using a tab 242 and another using the horizontal protrusions 235, alternate embodiments may use a mounting plate 110 that has only one option for hanging a cover on a mounting plate. Those of skill in the field will also recognize that the shapes and positions of the horizontal protrusions 235 and the tab 140 may be modified to hang the cover on the mounting plate in other ways.

Referring now to FIG. 4, the mounting plate 110 may not include a mounting bracket 170. Accordingly, the mounting plate 110 may be directly attached to a mounting surface (not shown) using fasteners placed through the securing apertures 409 of the top wall 206 of the mounting plate 110. In the arrangement shown in FIG. 4, once the mounting plate 110 is secured to the mounting surface, the tab aperture 140 of the cover 105 is placed through the tab 242 of the mounting plate 110 in order to hang the cover 105 on the mounting plate 110. The side wall 204 of the mounting plate 110 that extends from the base flange 202 to the top wall 206 provides a sufficient space/clearance between the mounting surface and the luminaire 110 such that the cover 105 can be hung on the tab 242 of the mounting plate 110 without interfering with the mounting surface, when the mounting plate 110 is directly secured to the mounting surface. As can be seen in the arrangement of FIG. 4, hanging the cover 105 on the mounting plate 110 with the tab 242 and tab aperture 240 leaves the cover 105 with its wiring (not shown) in close proximity to a power source (not shown) that would typically have wiring in proximity to the location where the mounting plate is secured. With the cover 105 hanging as shown in FIG. 4, there is sufficient clearance for an installer to complete the wiring connections using both hands and there is no need for the installer to hold the cover 105 in position while completing the installation. Once the wiring is complete, the cover 105 can be removed from the tab 242 and can be placed on the mounting plate 110 so that vertical protrusions 232 are inserted into top apertures 130 thereby securing the cover 105 to the mounting plate 110 as described above and illustrated in FIG. 1.

The present disclosure describes example embodiments and it should be appreciated by those skilled in the art that various modifications are well within the scope of the disclosure. From the foregoing, it will be appreciated that an embodiment overcomes the limitations of the prior art. Those skilled in the art will appreciate that the embodiments are not limited to any specifically discussed application and that the embodiments described herein are illustrative and not restrictive. From the description of the example embodiments, equivalents of the elements shown therein will suggest themselves to those skilled in the art, and ways of constructing other embodiments will suggest themselves to practitioners of the art.

We claim:

1. A luminaire comprising:

a mounting plate comprising a plurality of vertical protrusions disposed along a top edge of the mounting plate and a plurality of horizontal protrusions disposed along an inner surface of the mounting plate; and a cover comprising a plurality of top apertures and a light source coupled to a driver;

wherein the plurality of horizontal protrusions are inserted into the plurality of top apertures such that the driver can be coupled to a power source during installation of the luminaire, and wherein the plurality of vertical protrusions are inserted into the plurality of top apertures after the installation and when the luminaire is operational.

2. The luminaire of claim 1:

wherein the mounting plate further comprises apertures for securing the mounting plate to a surface, and wherein the mounting plate has an offset shape that provides the luminaire a clearance from the surface when the mounting plate is directly attached to the surface.

3. The luminaire of claim 1, wherein the mounting plate further comprises one or more brackets for attaching the mounting plate to a surface.

4. The luminaire of claim 1, wherein the mounting plate further comprises an aperture that permits a cable from the power source to pass therethrough.

5. The luminaire of claim 1, wherein the driver is mounted to an interior surface of the cover.

6. A luminaire comprising:

a mounting plate comprising a plurality vertical protrusions disposed along a top edge of the mounting plate and a tab disposed along the top edge of the mounting plate;

a cover comprising a plurality of top apertures, a tab aperture, and a light source coupled to a driver;

wherein the tab is inserted into the tab aperture such that the driver can be coupled to a power source during installation of the luminaire, and wherein the plurality of vertical protrusions are inserted into the plurality of top apertures after the installation and when the luminaire is operational.

7. The luminaire of claim 6:

wherein the mounting plate further comprises apertures for securing the mounting plate to a surface, and wherein the mounting plate has an offset shape that provides the luminaire a clearance from the surface when the mounting plate is directly attached to the surface.

8. The luminaire of claim 6, wherein the mounting plate further comprises one or more brackets for attaching the mounting plate to a surface.

9. The luminaire of claim 6, wherein the mounting plate further comprises an aperture that permits a cable from the power source to pass therethrough.

10. The luminaire of claim 6, wherein the driver is mounted to an interior surface of the cover.

11. A method for installing a luminaire comprising:

securing a mounting plate to a support;

inserting horizontal protrusions on an inner surface of the mounting plate into top apertures in a cover so that the cover hangs from the mounting plate;

connecting a driver to a power source, the driver coupled to a light source disposed within the cover; and removing the cover from the horizontal protrusions and inserting vertical protrusions on a top edge of the mounting plate into the top apertures thereby securing the cover to the mounting plate.

12. The method of claim 11, wherein the mounting plate is secured to the support via apertures in the mounting plate.

13. The method of claim 11, wherein the mounting plate is secured to the support via a bracket.

14. The method of claim 11, wherein the driver is connected to the power source by a cable that passes through an aperture in the mounting plate.

15. The method of claim 11, wherein the driver is mounted to an interior surface of the cover.

16. A method for installing a luminaire comprising:

securing a mounting plate to a support;

inserting a tab on a top edge of the mounting plate into a tab aperture in a cover so that the cover hangs from the mounting plate;

connecting a driver to a power source, the driver coupled to a light source disposed within the cover; and removing the cover from the tab and inserting vertical protrusions on the top edge of the mounting plate into the top apertures thereby securing the cover to the mounting plate.

17. The method of claim 16, wherein the mounting plate is secured to the support via apertures in the mounting plate.

18. The method of claim 16, wherein the mounting plate is secured to the support via a bracket.

19. The method of claim 16, wherein the driver is connected to the power source by a cable that passes through an aperture in the mounting plate.

20. The method of claim 16, wherein the driver is mounted to an interior surface of the cover.

* * * * *